US008725054B2

(12) United States Patent
Fukami et al.

(10) Patent No.: US 8,725,054 B2
(45) Date of Patent: May 13, 2014

(54) IMAGE FORMING DEVICE

(75) Inventors: Tsunemitsu Fukami, Aichi (JP); Tetsuya Okano, Aichi (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 15 days.

(21) Appl. No.: 13/432,167

(22) Filed: Mar. 28, 2012

(65) Prior Publication Data

US 2012/0251209 A1 Oct. 4, 2012

(30) Foreign Application Priority Data

Apr. 1, 2011 (JP) ..... 2011-081812

(51) Int. Cl.
*G03G 21/00* (2006.01)

(52) U.S. Cl.
USPC ..... 399/343; 399/344; 399/349; 399/358

(58) Field of Classification Search
USPC ..... 399/343, 344, 349, 358
See application file for complete search history.

(56) References Cited

U.S. PATENT DOCUMENTS

| | | | | |
|---|---|---|---|---|
| 7,539,432 | B2 | 5/2009 | Dan | |
| 7,693,460 | B2 | 4/2010 | Furukawa | |
| 2008/0031649 | A1 | 2/2008 | Dan | |
| 2008/0317506 | A1 * | 12/2008 | Furukawa | 399/223 |

FOREIGN PATENT DOCUMENTS

| | | |
|---|---|---|
| JP | 2003-162109 | 6/2003 |
| JP | 2008-039905 | 2/2008 |
| JP | 2009-003377 | 1/2009 |

* cited by examiner

*Primary Examiner* — Walter L Lindsay, Jr.
*Assistant Examiner* — Barnabas Fekete
(74) *Attorney, Agent, or Firm* — Banner & Witcoff, Ltd.

(57) ABSTRACT

An image forming device, including: photosensitive bodies arranged in parallel in a predetermined direction; a belt that runs in the predetermined direction to transfer a developer image formed on each of the photosensitive bodies to a sheet-like medium; recovering members that are respectively provided for the photosensitive bodies, wherein each recovering member recovers adhered substances adhered to each photosensitive body after the developer image was transferred to the sheet-like medium; a belt cleaner that removes the adhered substances adhered to the belt; a cleaning process execution unit that executes a cleaning process in which the adhered substances are transferred from each recovering member to the belt via each photosensitive body; and a cleaning time determination unit that determines a time period for which the cleaning process is executed, based on a color of the image formed on the sheet-like medium.

15 Claims, 3 Drawing Sheets

IMAGE FORMING DEVICE

CROSS-REFERENCE TO RELATED APPLICATION

This application claims priority under 35 U.S.C. §119 from Japanese Patent Application No. 2011-081812, filed on Apr. 1, 2011. The entire subject matter of the application is incorporated herein by reference.

BACKGROUND

1. Technical Field

Aspects of the present invention relate to an image forming device, such as a color printer.

2. Related Art

As an example of an image forming device, a device in which photosensitive drums respectively corresponding to yellow, magenta, cyan and black are arranged is known. In this configuration, on outer surfaces of the photosensitive drums, toner images are respectively formed.

There is a case where toner remains on the outer surface of the photosensitive drum without being transferred to paper. For this reason, for each of the photosensitive drums, a recovering member which recovers the toner remaining on the outer surface of the photosensitive drum is provided in the image forming device. During image formation, a recovering bias is supplied to the recovering member. By the effect of the recovering bias, the toner remaining on the outer surface of the photosensitive drum is transferred to the recovering member, and is held tentatively on the recovering member.

By executing a toner transfer process (a cleaning process) at a predetermined timing, the toner held on the recovering member is recovered by a cleaning unit via the photosensitive drum and a carrying belt. In the toner transfer process, a bias whose polarity is opposite to the recovering bias is supplied to the recovering member. In addition, a bias whose polarity is the same as that of a transfer bias is supplied to each transfer roller. By the effect of the bias supplied to the recovering member, the toner held on the recovering member is returned to the outer surface of the photosensitive drum. Then, by the effect of the bias supplied to each transfer roller, the toner returned to the outer surface of the photosensitive drum is transferred to the carrying belt. The toner transferred to the carrying belt is removed into the cleaning unit when the toner faces the cleaning unit.

SUMMARY

In each toner transfer process, a time period (i.e., a time required for the toner transfer process) for which the biases are supplied to the recovering member and the transfer roller is constant. Therefore, there is a case where a long time is wastefully consumed for the toner transfer process.

Aspects of the present invention are advantageous in that an image forming device capable of executing a cleaning process for an appropriate time period (length) is provided.

According to an aspect of the invention, there is provided an image forming device forming, on a sheet-like medium, an image of a monochromatic developer image or an image by superposition of a plurality of colors of developer images. The image forming device comprises: a plurality of photosensitive bodies arranged in parallel in a predetermined direction; a belt that runs in the predetermined direction so as to transfer a developer image formed on each of the plurality of photosensitive bodies to the sheet-like medium; recovering members that are respectively provided for the plurality of photosensitive bodies, wherein each recovering member recovers adhered substances adhered to each photosensitive body after the developer image was transferred to the sheet-like medium; a belt cleaner that removes the adhered substances adhered to the belt; a cleaning process execution unit that executes a cleaning process in which the adhered substances are transferred from each recovering member to the belt via each photosensitive body, by controlling each photosensitive body, the belt and each recovering member; and a cleaning time determination unit that determines a time period for which the cleaning process is executed, based on a color of the image formed on the sheet-like medium.

In the above described configuration, the plurality of photosensitive bodies are arranged in parallel in the predetermined direction. A developer image is formed on one photosensitive body, the developer image is transferred to the sheet-like medium, and as a result a monochromatic developer image (a monochromatic image) is formed on the sheet-like medium. Developer images are formed on the plurality of photosensitive bodies, and these developer images are transferred to the sheet-like medium such that the developer images are superimposed with respect to each other, and as a result a color developer image (a color image) is formed on the sheet-like medium.

The recovering member is provided for each of the photosensitive bodies. After the developer image is transferred from the photosensitive body to the sheet-like medium, the adhered substances adhered to the photosensitive body is recovered by the recovering member. By executing the cleaning process, the adhered substances recovered by the recovering member are transferred to the belt via the photosensitive body. Then, the adhered substances are removed from the belt by the belt cleaner. That is, the adhered substances recovered by the recovering member are recovered again by the belt cleaner through the cleaning process.

For example, when a monochromatic image is to be formed on the sheet-like medium, a developer image is formed on the photosensitive body corresponding to the monochrome, and developer images are not formed the other photosensitive bodies. Since the substances hardly adhere to the photosensitive body on which no developer image is formed, there is no necessity to recover again the adhered substances from the recovering member provided for the photosensitive body on which no developer image is formed.

For this reason, the length of the time period for which the cleaning process is executed is determined based on the color of the image formed on the sheet-like medium. For example, when a monochromatic image is formed on the sheet-like medium, the cleaning time may be determined based on the position of the photosensitive body on which the developer image is formed. As a result, it becomes possible to set the cleaning time for an appropriate time in response to the length of the distance in the predetermined direction between the position of the photosensitive body on which the developer image is formed and the position of the belt cleaner.

Therefore, it becomes possible to prevent a long time from being wastefully consumed for the cleaning process, and thereby it becomes possible to shorten the time period between the end of the image formation operation before the cleaning process and the start of the image formation operation after the cleaning process.

It is noted that various connections are set forth between elements in the following description. It is noted that these connections in general and unless specified otherwise, may be direct or indirect and that this specification is not intended to be limiting in this respect. Aspects of the invention may be implemented in computer software as programs storable on computer-readable media including but not limited to RAMs, ROMs, flash memory, EEPROMs, CD-media, DVD-media, temporary storage, hard disk drives, floppy drives, permanent storage, and the like.

BRIEF DESCRIPTION OF THE ACCOMPANYING DRAWINGS

DETAILED DESCRIPTION

Hereafter, an embodiment according to the invention will be described with reference to the accompanying drawings.

(1. Overall Configuration of Color Printer)

Figure 1:
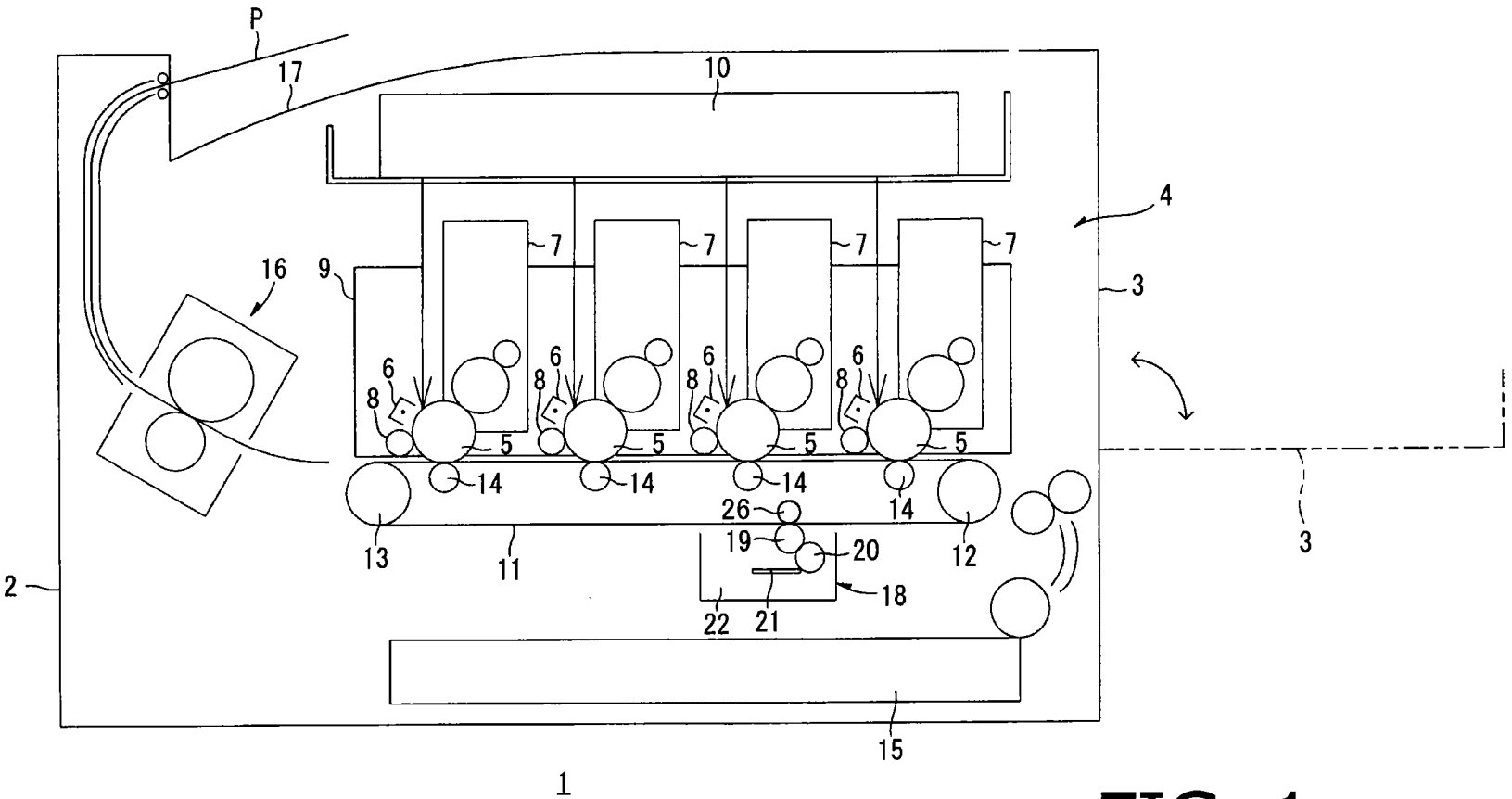
FIG. 1 is a cross sectional view of a color printer which is an example of an image forming device according to an embodiment.

As shown in FIG. 1, a color printer 1 which is an example of an image forming device includes a main body casing 2. On a front face of the main body casing 2, a front cover 3 which is an example of a cover is provided so as to open or close an opening 4.

The front side of the color printer 1 corresponds to the forward (the right side on the paper face of FIG. 1) in the front and rear direction (i.e., the left and right direction on the paper face of FIG. 1). In a state where the color printer 1 is placed on a flat surface, the direction orthogonal to the flat surface is the vertical direction. In this specification, the left and right sides of the color printer 1 are defined when the color printer 1 placed on the flat surface is viewed from the front side.

In the main body casing 2, photosensitive drums 5 which are examples of four photosensitive bodies are provided. Each photosensitive drum 5 is provided such that an outer circumferential surface thereof is rotatable about a rotation axis extending in the left and right direction. The four photosensitive drums 5 are provided for black, yellow, magenta and cyan, and are arranged in parallel at constant intervals in the front and rear direction in the order of yellow, magenta, cyan and black from the front side.

Around each photosensitive drum 5, a charger 6, a developer 7 and a recovering member 8 are provided. The charger 6 is arranged above the photosensitive drum 5 on the rear side of the photosensitive drum 5. The developer 7 is provided at an upper and rear portion of the photosensitive drum 5. The recovering member 8 is arranged on the rear side of the photosensitive drum 5.

The four photosensitive drums 5, and the charger 6, the developer 7 and the recovering member 8 provided around each photosensitive drum 5 are held, for example, on a common drawer frame 9. The drawer frame 9 is provided to be able to move in the horizontal direction between an accommodated position in the main body casing 2 and a drawn position outside the main body casing 2 in a state where the front cover 3 is opened. In this configuration, the drawer frame 9 and the photosensitive drums 5, the chargers 6, the developers 7 and the recovering members 8, which are formed as a drawer unit, can be detachably attachable to the main body casing 2 via the opening 4.

At the uppermost part in the main body casing 2, an exposure unit 10 which emits four laser beams for the respective colors is arranged.

During image formation, the photosensitive drum 5 is rotated in the clockwise direction when viewed from the left side. In accordance with rotation of the photosensitive drum 5, the outer surface of the photosensitive drum 5 is uniformly charged by electric discharge of the charger 6, and then is selectively exposed to the laser beam from the exposure unit 10. Through this exposure, charges are selectively removed from the outer surface of the photosensitive drum 5, and an electrostatic latent image is formed on the outer surface of the photosensitive drum 5. The electrostatic latent image is developed as a toner image, which is an example of a developer image, through supplying of the toner from the developer 7.

In the main body casing 2, a paper carrying belt 11 is provided at a position slightly lower than the center in the vertical direction. The paper carrying belt 11 is an endless belt wound around two rollers 12 and 13. The two rollers 12 and 13 are arranged in the front and rear direction to have a certain interval. In this configuration, the paper carrying belt 11 has a flat part extending in the front and rear direction and in the left and right direction between the upper edges of the two rollers 12 and 13. The flat part of the paper carrying belt 11 contacts the four photosensitive drums 5.

At positions opposite to the photosensitive drums 5 with respect to the flat part of the paper carrying belt 11, transfer rollers 14 are arranged. The paper carrying belt 11 and the four transfer rollers 14 form an example of a transfer belt.

At the bottom of the main body casing 2, a paper supply cassette 15 which accommodates paper P (which is an example of a sheet-like medium) is arranged. The paper P accommodated in the paper supply cassette 15 is carried into the flat part of the paper carrying belt 11 by various types of rollers. Then, the paper P is carried to the rear side by the paper carrying belt 11 through the space between the paper carrying belt 11 and each photosensitive drum 5.

During image formation, the paper carrying belt 11 revolves in the counterclockwise direction when viewed from the left side. The revolving direction of the paper carrying belt is an examples of a predetermined direction. The transfer roller 14 is applied a transfer bias. When a monochrome image is formed on the paper P, a toner image is formed on the photosensitive drum 5 for black. Then, the toner image is transferred to the paper P being carried by the paper carrying belt 11 through the effect of the transfer bias. With this configuration, a monochrome image formed of a black toner image is formed on the paper P. When a color image is formed on the paper P, toner images are formed on more than one photosensitive drum 5. Then, the toner images are transferred to the paper P being carried by the paper carrying belt 11 such that the toner images are superimposed with respect to each other on the paper P. As a result, a color image by superposition of respective color toner images is formed on the paper P.

After transfer of the toner image from the photosensitive drum 5 to the paper P, adhered substances, such as toner remaining on the outer surface of the photosensitive drum 5, are recovered by the recovering member 8 from the outer surface of the photosensitive drum 5 through the effect of a recovering bias supplied to the recovering member 8. The adhered substances recovered by the recovering member 8 are held on the recovering member 8 while the recovering bias is supplied to the recovering member 8.

On the rear side of the paper carrying belt 11, a fixing unit 16 is provided. The paper P on which the toner image has been transferred is carried to the fixing unit 16. In the fixing unit 16, the toner image is fixed on the paper P by application of heat and pressure. The paper P on which the toner image has been fixed is ejected to an ejection tray 17 provided on an upper surface of the main body casing 2.

Under the paper carrying belt 11, a belt cleaner 18 is provided. The belt cleaner 18 includes a primary cleaning roller 19, a secondary cleaning roller 20, a scraper 21 and a reservoir 22.

The primary cleaning roller 19 is provided to be rotatable about a center axis thereof defined as a rotation axis extending in the left and right direction, and is arranged to contact the lower part of the paper carrying belt 11 throughout the width direction. The secondary cleaning roller 20 is provided to be rotatable about a center axis thereof defined as a rotation axis extending in the left and right direction, and contacts the primary cleaning roller 19 throughout the width direction. On the opposite side of the primary cleaning roller 19 with respect to the paper carrying belt 11, a backup roller 26 which presses the paper carrying belt 11 against the primary cleaning roller 19 is arranged. The backup roller 26 is attached to a frame of the main body casing 2 to be rotatable and to be substantially parallel with the axial direction of the rollers 12 and 13.

The adhered substances adhered to the paper carrying belt 11 are removed from the paper carrying belt 11 by the belt cleaner 18. Specifically, a primary cleaning bias and a secondary cleaning bias are respectively supplied to the primary cleaning roller 19 and the secondary cleaning roller 20. The adhered substances on the paper carrying belt 11 are transferred to the primary cleaning roller 19 through the effect of the primary cleaning bias when the adhered substances face the primary cleaning roller 19. The adhered substances which have been transferred to the primary cleaning roller 19 are further transferred to the secondary cleaning roller 20 through the potential difference between the primary cleaning bias and the secondary cleaning bias. The transferred substances which have been transferred to the secondary cleaning roller 20 are scraped off by the scraper 21 from the secondary cleaning roller 20. The adhered substances scraped off by the scraper 21 are stored in the reservoir 22.

(2. Electric Configuration of Color Printer)

Figure 2:
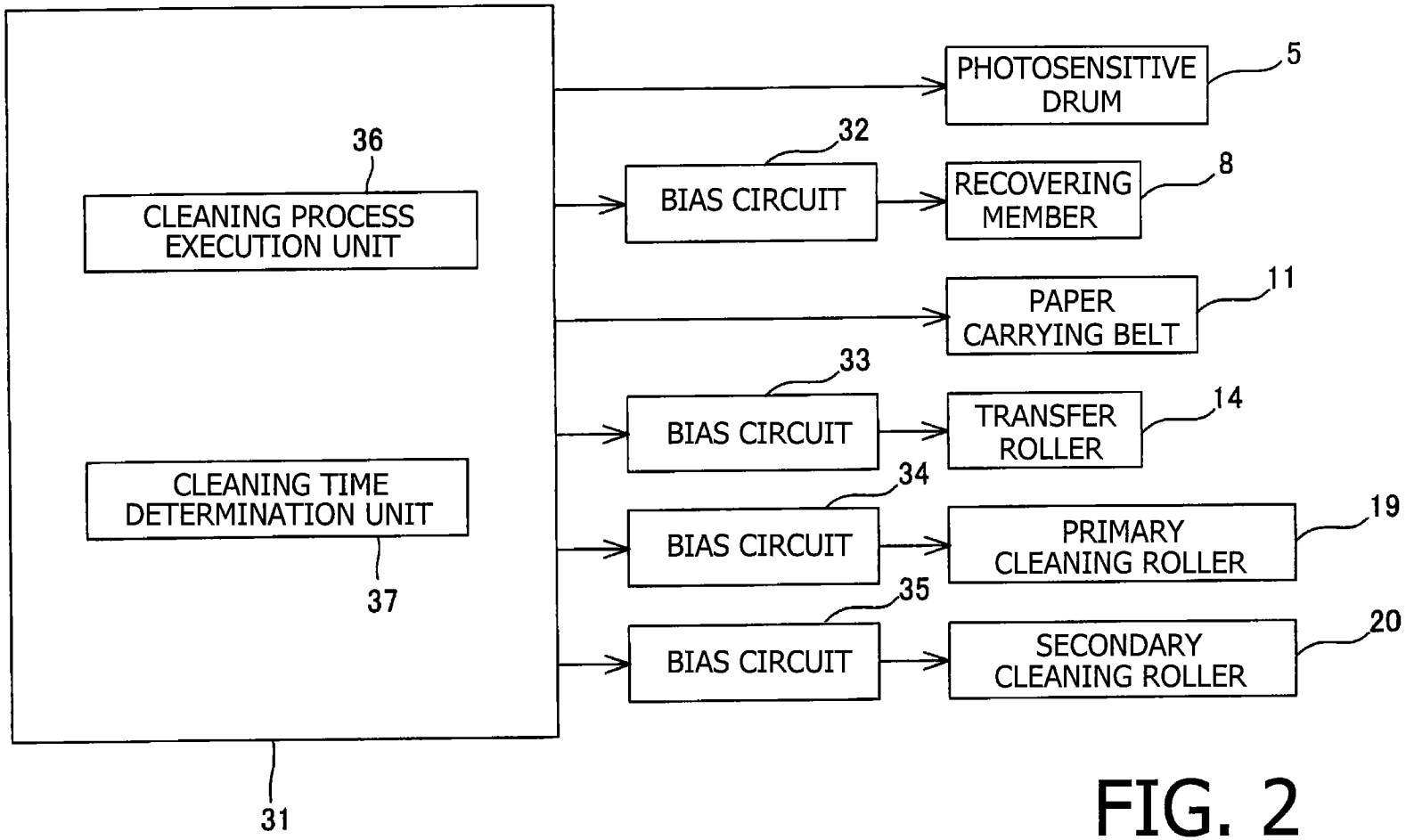
FIG. 2 is a block diagram illustrating an electrical configuration of the color printer.
Figure 3:
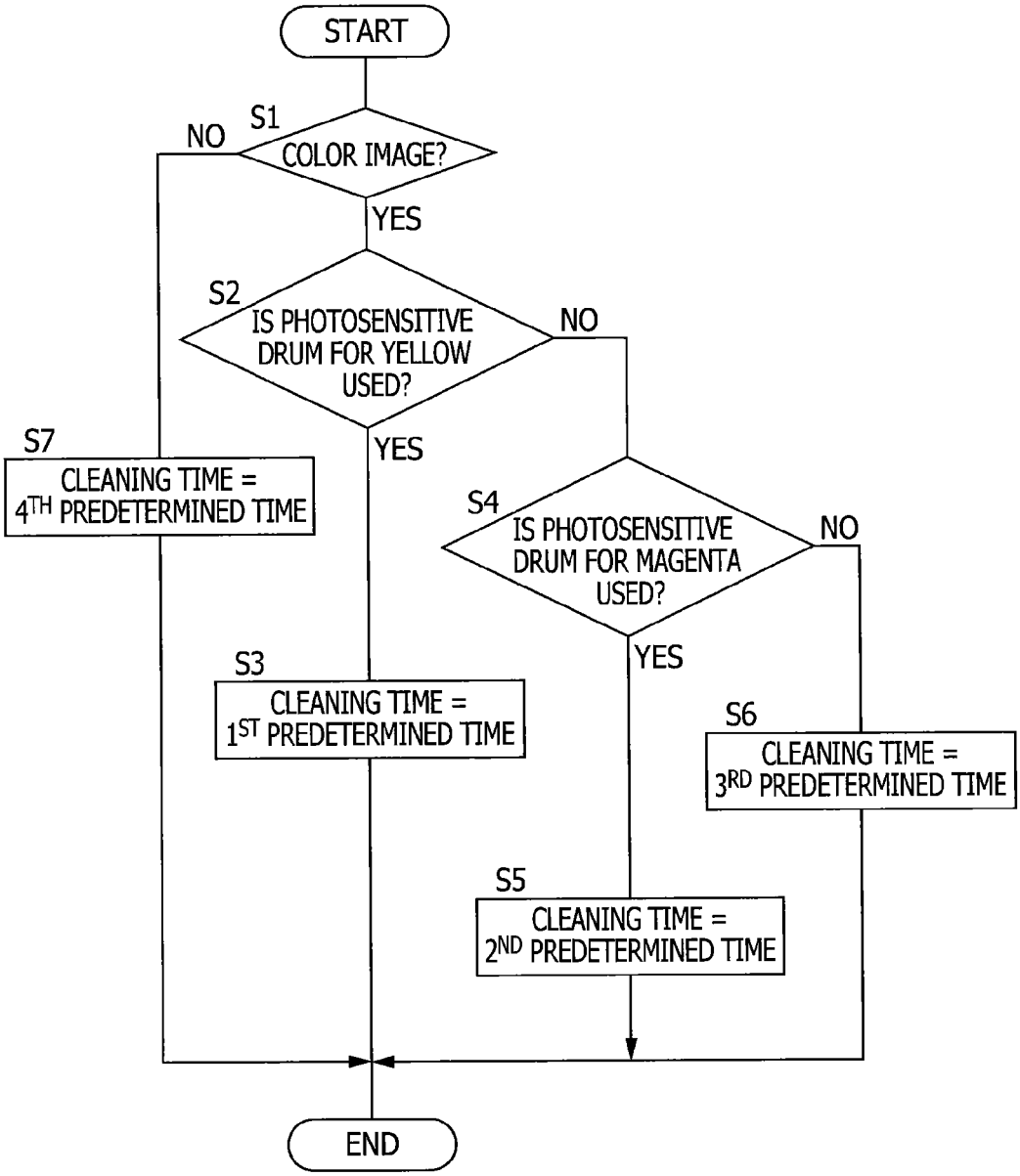
FIG. 3 is a flowchart illustrating a process for determining a cleaning time.

As shown in FIG. 2, the color printer 1 includes a control unit 31 formed of a microcomputer having a CPU, a RAM and a ROM.

To the control unit 31, control targets including the photosensitive drums 5, the recovering members 8, the paper carrying belt 11 (roller 13) and the four transfer rollers 14 (which constitute an example of a transfer belt), the primary cleaning roller 19 and the secondary cleaning roller 20 are connected. The recovering members 8, the transfer rollers 14, the primary cleaning roller 19 and the secondary cleaning roller 20 are connected to the control unit 31 via bias circuits 32, 33, 34 and 35, respectively.

The control unit 31 includes, as actual components, a cleaning process execution unit 36 and a cleaning time determination unit 37. The cleaning process execution unit 36 and the cleaning time determination unit 37 are functional processing units realized, as software, by program processing by the CPU.

The cleaning process execution unit 36 executes a cleaning process in which the adhered substances are transferred from the recovering member 8 to the paper carrying belt 11 via the photosensitive drum 5. Specifically, by the cleaning process execution unit 36, the photosensitive drum 5 is controlled, and is rotated at a constant speed. Furthermore, by the cleaning process execution unit 36, the bias circuit 32 is controlled, and a bias whose polarity is the inverse of the recovering bias of the recovering member 8 is supplied from the bias circuit 32 to the recovering member 8. Furthermore, by the cleaning process execution unit 36, the bias circuit 33 is controlled and a bias equal to the transfer bias is supplied from the bias circuit 33 to the transfer roller 14.

Through the effect of the bias supplied to the recovering member 8, the adhered substances held on the recovering member 8 are returned to the outer surface of the photosensitive drum 5. Then, the adhered substances which have been returned to the photosensitive drum 5 are transferred to the paper carrying belt 11 through the effect of the bias supplied to the transfer roller 14.

The adhered substances which have been transferred to the paper carrying belt 11 are removed to the belt cleaner 18 when the adhered substances face the belt cleaner 18.

The cleaning time determination unit 37 executes a cleaning time determination process described below, and determines an execution time for the cleaning process (hereafter, referred to as a "cleaning time").

(3. Cleaning Time Determination Process)

The cleaning process by the cleaning process execution unit 36 is executed in the interval between the end of a sequence of image formation operations and the start of a next image formation operation. The sequence of image formation operations means an operation executed to form an image on one or more sheets of paper P in response to a one job command inputted from, for example, a personal computer connected to the color printer 1.

Before start of the cleaning process, the cleaning time determination process is executed by the cleaning time determination unit 37.

In the cleaning time determination process, first the control unit 31 judges whether a color image has been formed on the paper P by the image formation operation previously finished (step S1). Whether the color image has been formed can be judged, for example, based on image data which the color printer 1 received from, for example, a personal computer. That is, if the image data received by the color printer 1 includes data for forming a toner image of yellow, magenta or, cyan, it can be judged that a color image is formed on the paper P. On the other hand, if the image data received by the color printer 1 includes only data for forming a toner image of black, it can be judged that a monochrome image is formed on the paper P, i.e., a color image is not formed on the paper P.

When the color image has been formed on the image formation operation previously executed (step S1: YES), next the control unit 31 judges whether a toner image has been formed on the photosensitive drum 5 for yellow (step S2). Whether a toner image of yellow has been formed can be judged, for example, based on the image data which the color printer 1 received from, for example, a personal computer. That is, if the image data received by the color printer 1 includes data for forming a toner image of yellow, it can be judged that a yellow toner image has been formed on the photosensitive drum 5.

When a toner image of yellow has been formed (step S2: YES), the cleaning time is set for a first predetermined time (step S3). The first predetermined time is a time set depending on a distance defined between the photosensitive drum 5 for yellow and the belt cleaner 18 along the circumferential direction of the carrying belt 11.

When a toner image of yellow has not been formed (step S2: NO), the control unit 31 judges whether a toner image has been formed on the photosensitive drum 5 of magenta (step S4). Whether a toner image of magenta has been formed can be judged, for example, based on image data which the color printer 1 received from, for example, a personal computer. That is, if the image data received by the color printer 1 includes data for forming a toner image of magenta, it can be judged that the toner image of magenta has been formed on the photosensitive drum.

When the toner image of magenta has been formed (step S4: YES), the cleaning time is set for a second predetermined time (step S5). The second predetermined time is a time set depending on a distance defined between the photosensitive drum 5 for magenta and the belt cleaner 18 along the circumferential direction of the carrying belt 11, and is set to be shorter than the first predetermined time.

When the toner image of magenta has not been formed (step S4: NO), the cleaning time is set for a third predetermined time (step S6). The third predetermined time is a time set depending on a distance defined between the photosensitive drum 5 for cyan and the belt cleaner 18 along the circumferential direction of the carrying belt 11, and is set to be shorter than the second predetermined time.

When a color image has not been formed on the paper P in the previous image formation operation (step S1: NO), i.e., when only a monochrome image is formed on the paper P in the previous image formation operation, the cleaning time is set for a fourth predetermined time (step S7). The fourth predetermined time is a time set depending on a distance defined between the photosensitive drum 5 for black and the belt cleaner 18 along the circumferential direction of the carrying belt 11, and is set to be shorter than the third predetermined time.

(4. Advantages)

(4-1. Advantages 1)

As described above, a plurality of photosensitive drums 5 are arranged in parallel in the revolving direction of the paper carrying belt 11. A monochromatic toner image (a monochromatic image) is formed on the paper P, by forming a toner image on one photosensitive drum 5 and transferring the toner image on the paper P. A color toner image (a color image) is formed on the paper P, by forming toner images respectively on the plurality of photosensitive drums 5 and transferring the toner images such that the toner images are superimposed on the paper P.

The recovering members 8 are provided respectively for the photosensitive drums 5. After the toner image is transferred from the photosensitive drum 5 to the paper P, the adhered substances adhered to the photosensitive drum 5 are recovered by the recovering member 8. By executing the cleaning process, the adhered substances recovered by the recovering member 8 are transferred to the paper carrying belt 11 via the photosensitive drum 5. Then, the adhered substances are removed from the paper carrying belt 11 by the belt cleaner 18. That is, the adhered substances recovered by the recovering member 8 are recovered again into the belt cleaner 18 through the cleaning process.

For example, when a monochromatic image is formed on the paper P, a toner image is formed on the photosensitive drum 5 corresponding to the color of the monochromatic image, and no toner images are formed on the other photosensitive drums 5. Since substances hardly adhere to the photosensitive drums on which toner images are not formed, there is no necessity to recover again the adhered substances, from the recovering members 8 provided for the photosensitive drums on which toner images are not formed, to the belt cleaner 18.

The length of time (cleaning time) for which the cleaning process is executed is determined based on the color of the image formed on the paper P. For example, when a monochromatic image is formed on the paper P, the length of the cleaning time may be determined based on the position of the photosensitive drum 5 on which the monochromatic toner image is formed.

As a result, it becomes possible to set the cleaning time for an appropriate time which corresponds to the distance between the belt cleaner 18 and the photosensitive drum 5 on which the toner image has been formed, along the circumferential direction of the paper carrying belt 11.

Therefore, it becomes possible to prevent a long time from being wastefully consumed for the cleaning process, while recovering again, from the recovering member 8, the adhered substances adhered to the recovering member 8 corresponding to the photosensitive drum 5 on which the toner image is formed. As a result, it becomes possible to shorten the time period between the end of the image formation operation before the cleaning process and the start of the image formation operation after the cleaning process.

(4-2. Advantages 2)

The length of the cleaning time is determined based on the position of the most upstream side one of the photosensitive drums 5 on which the toner images are formed, in the circumferential direction of the paper carrying belt 11, with respect to the position of the belt cleaner 18.

As a result, it becomes possible to prevent a long time from being wastefully consumed for the cleaning process, while recovering again the adhered substances from the recovering members 8 corresponding to all the photosensitive drums 5 on which the toner images are formed, to the belt cleaner 18.

(4-3. Advantages 3)

In general, on the image forming device capable of forming a color image on the paper P by superimposition of toner images having a plurality of colors, monochrome images are most frequently formed on the paper P. When a monochrome image is formed on the paper P, recovering of the adhered substances from the recovering member 8 corresponding to the photosensitive drum 5 on which a black toner image has been formed, to the belt cleaner 18, in the subsequent cleaning process is sufficient.

Since the photosensitive drum 5 on which a black toner image is formed is located nearest to the belt cleaner 19 in the circumferential direction of the paper carrying belt 11, the time period required for the cleaning process after formation of a monochrome image can be shortened. Therefore, it becomes possible to shorten the time period required for the cleaning process which is most frequently executed, and thereby it becomes possible to shorten the time period between the end of the image formation operation before the cleaning process and the start of the image formation operation after the cleaning process.

Although the present invention has been described in considerable detail with reference to certain preferred embodiments thereof, other embodiments are possible.

The cleaning time determination unit 37 may determine the cleaning time based on whether the color of the image formed on the paper P in the image formation operation executed before the cleaning process is monochromatic or color. For example, when a monochromatic image is formed on the paper, the cleaning time may be set for the fourth predetermined time (the time set depending on the distance between the photosensitive drum 5 for black and the belt cleaner 18 along the circumferential direction of the paper carrying belt 11), and when a color image is formed on the paper P, the cleaning time may be set for the first predetermined time (the time set depending on the distance between the photosensitive drum 5 for yellow and the belt cleaner 18 along the circumferential direction of the paper carrying belt 11).

An optical sensor may be arranged closely to each photosensitive drum 5. In this case, whether a toner image is formed on each photosensitive drum 5 may be judged based on the color of the outer surface of each photosensitive drum 5 detected by the optical sensor, and the length of the cleaning time may be determined based on the judgment result.

Furthermore, a potential sensor may be arranged closely to each photosensitive drum 5. In this case, whether a toner image is formed on each photosensitive drum 5 may be judged based on the surface potential of the photosensitive drum 5 detected by the potential sensor, and the length of the cleaning time may be determined based on the judgment result.

What is claimed is:

1. An image forming device comprising:

a plurality of photosensitive bodies configured to carry toner images, respectively;

a belt configured to carry a medium along a path;

a plurality of recovering members that are respectively provided for the plurality of photosensitive bodies, wherein each of the recovering members is configured to recover adhered substances remaining on a respective one of the photosensitive bodies after a respective one of the toner images is transferred to the medium;

a belt cleaner configured to remove the adhered substances from the belt;

a cleaning process execution unit configured to control at least one of the photosensitive bodies, at least one of the recovering members, and the belt to execute a cleaning process in which the adhered substances are transferred from the at least one of the recovering members to the belt via the at least one of the photosensitive bodies; and a cleaning time determination unit configured to determine a time period for executing the cleaning process by identifying which one of the plurality of photosensitive bodies used in a preceding print job is farthest along the path from the belt cleaner, wherein the time period is based on a distance between the belt cleaner and the identified photosensitive body.

2. The image forming device according to claim 1, wherein the cleaning time determination unit is configured to determine whether the preceding print job comprised a color toner image or a black toner image.

3. The image forming device according to claim 1, wherein a photosensitive body from among the plurality of photosensitive bodies that is closest along the path to the belt cleaner is configured to transfer black toner.

4. The image forming device according to claim 1, wherein the photosensitive bodies are arranged in parallel at intervals along the path.

5. The image forming device according to claim 1, wherein each of the photosensitive bodies is configured to transfer a different color toner.

6. The image forming device according to claim 1, wherein an order, along the path from farthest from the belt cleaner to closest to the belt cleaner, of the photosensitive bodies comprises: a photosensitive body configured to transfer yellow toner, a photosensitive body configured to transfer magenta toner, a photosensitive body configured to transfer cyan toner, and a photosensitive body configured to transfer black toner.

7. The image forming device according to claim 6, wherein the time period is greater when the photosensitive body configured to transfer yellow toner is the identified photosensitive body than when the photosensitive body configured to transfer the magenta toner is the identified photosensitive body.

8. The image forming device according to claim 1, wherein the time period increases as the distance between the belt cleaner and the identified photosensitive body increases.

9. The image forming device according to claim 1, wherein the cleaning time determination unit is configured to:

determine whether the preceding print job comprised a monochromatic image or a color image; and in response to determining that the preceding print job comprised the color image, determine whether the preceding print job used a particular photosensitive body, from among the plurality of photosensitive bodies, that is configured to transfer a particular color of toner.

10. The image forming device according to claim 1, wherein the photosensitive bodies are configured to transfer different colors of toner; and wherein the cleaning time determination unit is configured to:

determine that a particular color of the different colors of toner was used in the preceding print job; and set the time period based on the particular color.

11. The image forming device according to claim 1, wherein the cleaning process execution unit comprises:

at least one processor; and memory storing computer-executable instructions that, when executed by the at least one processor, cause the image forming device to function as the cleaning process execution unit.

12. The image forming device according to claim 1, wherein the cleaning time determination unit comprises:

at least one processor; and memory storing computer-executable instructions that, when executed by the at least one processor, cause the image forming device to function as the cleaning time determination unit.

13. An image forming device, comprising:

a plurality of photosensitive bodies, the plurality of photosensitive bodies comprising a first photosensitive body and a second photosensitive body;

a belt configured to rotate within a path and face each of the plurality of photosensitive bodies;

a belt cleaner configured to remove substances from the belt; and a controller configured to:

determine whether the first photosensitive body is used in a print job;

in response to determining that the first photosensitive body is used in the print job, determine a first time period and control the belt cleaner to remove the substances from the belt for the first time period, wherein the first time period is based on a first distance along the path between the belt cleaner and the first photosensitive body;

in response to determining that the first photosensitive body is not used in the print job, determine whether the second photosensitive body is used in the print job; and in response to determining that the second photosensitive body is used in the print job, determine a second time period and control the belt cleaner to remove the substances from the belt for the second time period, wherein the second time period is based on a second distance along the path between the belt cleaner and the second photosensitive body, wherein the second distance is different from the first distance, and wherein the second time period is different from the first time period.

14. The image forming device of claim 13, wherein the plurality of photosensitive bodies further comprises a third photosensitive body; and wherein the controller is further configured to:

in response to determining that the second photosensitive body is not used in the print job, determine whether the third photosensitive body is used in the print job; and in response to determining that the third photosensitive body is used in the print job, determine a third time period and control the belt cleaner to remove the substances from the belt for the third time period, wherein the third time period is based on a third distance along the path between the belt cleaner and the third photosensitive body, wherein the third distance is different from the second distance, and wherein the third time period is different from the second time period.

15. The image forming device of claim 14, wherein the third distance is less than the second distance and the second distance is less than the first distance, and wherein the third time period is less than the second time period and the second time period is less than the first time period.

* * * * *